US011205861B2

(12) United States Patent
Bulgajewski et al.

(10) Patent No.: US 11,205,861 B2
(45) Date of Patent: Dec. 21, 2021

(54) STAKING TERMINAL FOR A COAXIAL CABLE

(71) Applicant: Illinois Tool Works Inc., Glenview, IL (US)

(72) Inventors: Edward Bulgajewski, Genoa, IL (US); John Healey, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/961,182

(22) PCT Filed: Jan. 14, 2019

(86) PCT No.: PCT/US2019/013457

§ 371 (c)(1),
(2) Date: Jul. 9, 2020

(87) PCT Pub. No.: WO2019/147426

PCT Pub. Date: Aug. 1, 2019

(65) Prior Publication Data

US 2020/0335884 A1 Oct. 22, 2020

Related U.S. Application Data

(60) Provisional application No. 62/621,310, filed on Jan. 24, 2018.

(51) Int. Cl.
*H01R 4/18* (2006.01)
*H01R 4/2406* (2018.01)
(Continued)

(52) U.S. Cl.
CPC ..... *H01R 4/185* (2013.01); *H01R 4/2406* (2018.01); *H01R 9/0518* (2013.01);
(Continued)

(58) Field of Classification Search
CPC .... H01R 4/185; H01R 4/2406; H01R 9/0518; H01R 12/598; H01R 12/63; H01R 12/68;
(Continued)

(56) References Cited

U.S. PATENT DOCUMENTS 3,383,457 A * 5/1968 Schumacher ..... H01R 43/04 174/261
6,123,587 A * 9/2000 Beloritski ..... H01R 9/0515 439/828
(Continued)

FOREIGN PATENT DOCUMENTS

CN 2615891 Y 5/2004
CN 201638944 U 11/2010
(Continued)

OTHER PUBLICATIONS

International Search Report and Written Opinion for PCT/2019/013457, dated Mar. 14, 2019.

*Primary Examiner* — Jean F Duverne
(74) *Attorney, Agent, or Firm* — Quarles & Brady LLP

(57) ABSTRACT

A staking terminal includes a conductor portion having a conductor platform, a first plurality of tines extending from the conductor platform, and a conductor crimp extending from the conductor platform. The conductor platform and the tines are not coplanar in a folded configuration. The staking terminal further includes a ground portion having a ground platform, a second plurality of tines extending from the ground platform, and a first braid crimp extending from the ground platform. The ground platform and the tines are not coplanar in the folded configuration.

20 Claims, 6 Drawing Sheets

(51) Int. Cl.

| | |
|---|---|
| ***H01R 9/05*** | (2006.01) |
| ***H01R 12/59*** | (2011.01) |
| ***H01R 12/63*** | (2011.01) |
| ***H01R 12/68*** | (2011.01) |

(52) U.S. Cl.
CPC ..... *H01R 12/598* (2013.01); *H01R 12/63* (2013.01); *H01R 12/68* (2013.01)

(58) Field of Classification Search
CPC .... H01R 4/188; H01R 43/04; H01R 13/6591; H01R 12/75
See application file for complete search history.

(56) References Cited

U.S. PATENT DOCUMENTS

| | | | | |
|---|---|---|---|---|
| 8,192,209 | B1 * | 6/2012 | Li | H01R 13/6591 439/98 |
| 9,306,301 | B2 * | 4/2016 | Shimoji | H01R 12/75 |
| 2018/0014362 | A1 | 1/2018 | Bulgajewski et al. | |

FOREIGN PATENT DOCUMENTS

| | | | |
|---|---|---|---|
| CN | 202581539 | U | 12/2012 |
| CN | 106129726 | A | 11/2016 |
| JP | 2003151667 | A | 5/2003 |

* cited by examiner

STAKING TERMINAL FOR A COAXIAL CABLE

CROSS REFERENCE TO RELATED APPLICATIONS

The present application represents the United States National Stage of International Application No. PCT/US2019/013457, filed Jan. 14, 2019, which claims priority to U.S. Application Ser. No. 62/621,310, filed on Jan. 24, 2018, the entire contents of which are incorporated by reference in their entirety.

BACKGROUND

1. Field of the Disclosure

Embodiments of the present disclosure generally relate to coaxial cables, and more particularly, to a crimpable staking terminal for a coaxial cable that is configured to couple to a flex circuit, such as a printed antenna.

2. Description of the Background of the Disclosure

A coaxial cable is an electrical cable that typically comprises four main components: 1) a copper or otherwise conductive core, 2) an inner dielectric insulator that insulates the core, 3) a woven copper shield that surrounds the core, and 4) an insulating outer jacket or sheath. The term "coaxial" refers to the fact that the inner conductor and the copper shield share a geometric axis. Coaxial cables are typically used as transmission lines that can carry high frequencies with low losses, and are used to transmit various signals, such as those used for signal transmission of various electrical and electronic components, such as televisions, computers, and the like. More specifically, coaxial cables are typically used to carry cable television signals, to connect radio transmitters and receivers to antennas, as broadband internet networking cables, and as high-speed computer data busses, among other uses.

While coaxial cables have a number of uses in the field of signal transmission, the types of connectors that allow a coaxial cable to be electrically connected with a source or receiver are limited. A coaxial cable conducts an electrical signal using an inner conductor core and further includes a conductive shield that is coaxial with, but spaced apart from the core. The shield is typically kept at ground potential, so the connectors used for coaxial cable connection have been designed to maintain a coaxial form across the connection, i.e., the core, and a conductive, but separated outer portion, i.e., the shield. Connectors for coaxial cables are usually plated with high-conductivity metals such as silver or tarnish-resistant gold.

To that end, connecting a coaxial cable to a polymer-based flexible ("flex") circuit poses challenges due to the flexible nature of flex circuits. In light of the dual-connection necessary to connect a coaxial cable with a source or receiver, typical coaxial connectors are unable to be soldered directly to a flexible surface of a flex circuit, which is a common solution for other types of wires. Moreover, the dual core conductor wire and conductive shield of a coaxial cable typically need to be connected to separate radio frequency (RF) signal and ground planes, as used in a printed circuit antenna. As such, soldering is not well-suited for such applications.

In light of the above, systems or devices for connecting or coupling a coaxial cable with a flexible or polymeric substrate are needed.

SUMMARY

In one aspect, a staking terminal for connecting a coaxial cable to a flex circuit includes a conductor portion comprising a conductor platform, a first plurality of tines extending from the conductor platform, and a conductor crimp extending from the conductor platform, wherein the conductor platform and the tines are not coplanar in a folded configuration. The staking terminal further includes a ground portion comprising a ground platform, a second plurality of tines extending from the ground platform, and a first braid crimp extending from the ground platform, wherein the ground platform and the tines are not coplanar in the folded configuration.

In another aspect, a staking terminal for connecting a coaxial cable to a flex circuit includes a conductor portion comprising a first plurality of tines depending downward and a conductor crimp extending upward, wherein the conductor crimp includes a first plurality of grooves. The staking terminal further includes a ground portion comprising a second plurality of tines, a first braid crimp, and a second braid crimp, wherein the first braid crimp includes a second plurality of grooves, and the second braid crimp includes a third plurality of grooves.

In yet another aspect, a method of installing a staking terminal for connecting a coaxial cable to a flex circuit includes the step of providing a conductor portion comprising a conductor platform, a first plurality of tines extending from the conductor platform, and a conductor crimp extending from the conductor platform, wherein the conductor platform, the first plurality of tines, and the conductor crimp are coplanar in a first configuration. The method further includes the step of providing a ground portion comprising a ground platform, a second plurality of tines extending from the ground platform, and a first braid crimp extending from the ground platform, wherein the ground platform, the second plurality of tines, and the first braid crimp are coplanar in the first configuration. Still further, the method includes the steps of manipulating the first plurality of tines and the second plurality of tines such that the first plurality of tines and the second plurality of tines are not coplanar with the conductor platform and the ground platform, respectively, and piercing the first plurality of tines and the second plurality of tines through a flexible substrate.

DETAILED DESCRIPTION

Embodiments of the present disclosure provide for a terminal, i.e., a staking terminal, which can be electrically coupled to a coaxial cable and is configured to securely couple the coaxial cable to a flexible circuit. However, it is contemplated that the staking terminal described herein may be coupled with a rigid circuit or another type of circuit. Embodiments of the present disclosure allow both the ground, i.e., the shield, and signal components of the coaxial cable, i.e., the core, to be crimped to the staking terminal. The disclosure of this application may be useful in situations where a coaxial cable is coupled with a flexible circuit, for example, with respect to windshield systems of vehicles. Instead of being configured to be soldered to the flexible circuit, the staking terminal described herein includes one or more piercing tines that allow the staking terminal to be physically coupled with the flexible circuit and electrically coupled with one or more conductors provided along the flexible circuit, thereby connecting the ground and signal circuits, respectively, to a printed flex circuit, such as a printed flexible antenna.

Figure 1A:
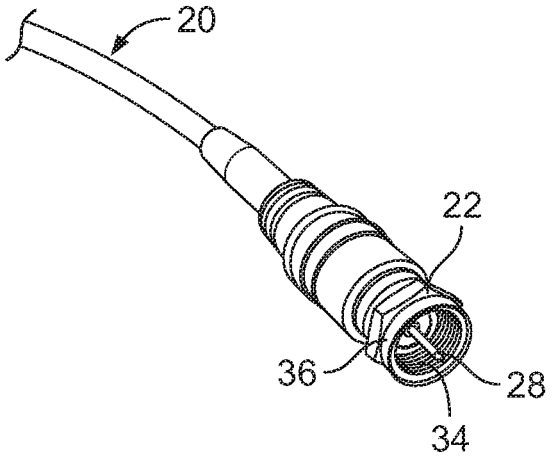
FIG. 1A PRIOR ART
FIG. 1A is a perspective view of a coaxial cable having a female connector.
Figure 1B:
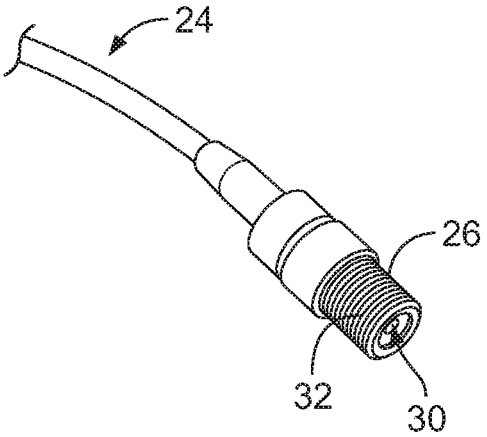
FIG. 1B PRIOR ART
FIG. 1B is a perspective view of a coaxial cable having a male connector.

FIGS. 1A and 1B illustrate views of a first coaxial cable 20 having a female connector 22, and a second coaxial cable 24 having a male connector 26. The first coaxial cable 20 and the second coaxial cable 24 may be coupled together by mating the female connector 22 with the male connector 26, thereby forming an electrical connection. In the illustrated figures, the female connector 22 may be rotatable. The female connector 22 includes a center core 28, which may be a copper wire. The center core 28 acts as a conductor to allow for an electrical signal to be passed through the center core 28. The male connector 26 includes an aperture 30 at a distal end thereof, the aperture 30 being positioned to receive the center core 28 when the female connector 22 is coupled with the male connector 26. When the female connector 22 and the male connector 26 are coupled with one another, the center core 30 is electrically coupled with a center core (not shown) within the second coaxial cable 24.

Still referring again to FIGS. 1A and 1B, when the first coaxial cable 20 is securely coupled with the second coaxial cable 24 via the female connector 22 and the male connector 26, two electrical connections are formed. The first electrical connection is formed by the center core 28 that extends from the first coaxial cable 20 (as noted above), an example of a center core being show more clearly in FIGS. 3 and 4. The second electrical connection is formed between an outer threaded portion 32 of the male connector 26 and an inner threaded portion 34 of a rotatable portion 36 of the female connector 22.

The first and second electrical connections are required for the coaxial cable to operate effectively, thus, the connectors 22, 26 are formed to effectuate this connection. The connectors 22, 26 of the coaxial cables 20, 24 are shown for illustrative purposes, to provide context as to how a coaxial cable becomes electrically connected with a source or receiver. While the coaxial cables 20, 24 may comprise the same cable having different connectors at distal ends thereof, for purposes of clarity, a coaxial cable 38 is shown throughout the remaining figures for clarity and ease of discussion (see FIGS. 3, 4, 6, and 9). The coaxial cable 38 is identical in all material aspects to the coaxial cables 20, 24.

Figure 2:
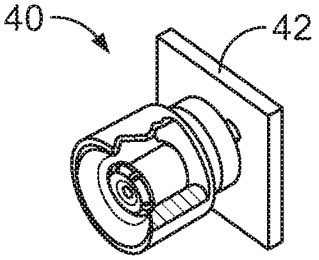
FIG. 2 PRIOR ART
FIG. 2 is a perspective, partially cutaway view of a connector for connecting a coaxial cable with a rigid circuit board.

Referring now to FIG. 2, a circuit board connector 40 is shown, which is illustrated so as to provide context as to what has been used as a prior art solution to connect a coaxial cable to a circuit board 42. Historically, connectors, such as the circuit board connector 40, allow for a coaxial cable, such as the second coaxial 24, to be coupled with a circuit board. Such circuit board connectors 40 are rigid and require that the coaxial cable be inserted and secured in the rigid configuration of the connector 40, e.g., at an angle of 90 degrees outward from the circuit board. The circuit board connector 40 is typically soldered on the circuit board 42 and a mating connection is typically achieved via a threaded engagement or a push type connection between the circuit board 42 and the coaxial cable 24, similar to the method of coupling as described above with respect to FIGS. 1A and 1B.

Figure 3:
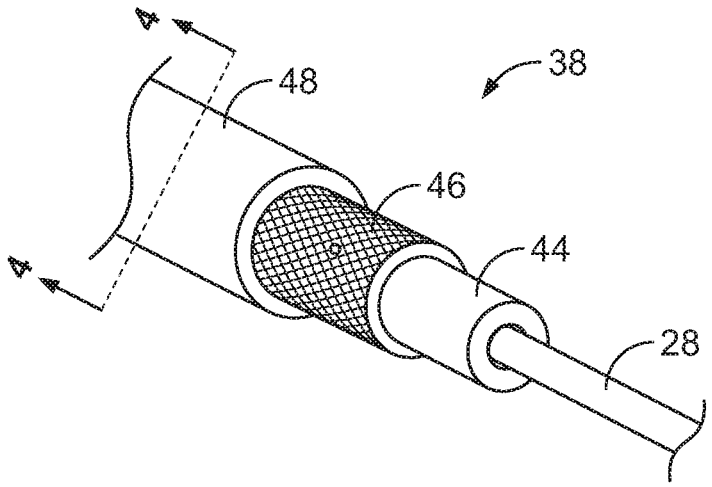
FIG. 3 is a perspective, cutaway view of a coaxial cable illustrating the components of the coaxial cable.
Figure 4:
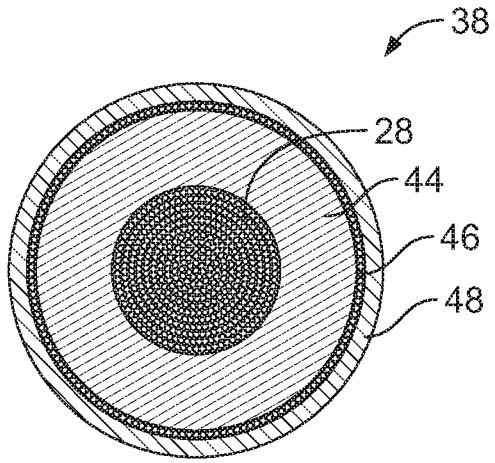
FIG. 4 is an enlarged, cross-sectional view of the coaxial cable taken through line 4-4 of FIG. 3.

Referring to FIG. 3, a breakaway view of the coaxial cable 38 is shown. In this view, the four main components of a coaxial cable are illustrated. Specifically, the center core 28, a dielectric insulator 44, a metallic shield 46, and a plastic jacket or insulation 48 are shown, each of these elements fully circumscribing the preceding element. As such, the dielectric insulator 44 fully circumscribes the center core 28, the metallic shield 46 fully surrounds the dielectric insulator 44, and the insulation 48 fully surrounds the metallic shield 46. While alternative constructions of a coaxial cable may be possible, the following disclosure is intended to provide a method of connecting the above-described coaxial cable 38 with a flexible or polymeric substrate, as described hereinafter below. In the context of FIGS. 1A and 1B, the metallic shield 46 is electrically coupled with the threaded portions 32, 34 of the male and female connectors 26, 22. FIG. 4 illustrates the above-described elements in the cross-section taken through line 4-4 of FIG. 3.

Figure 5:
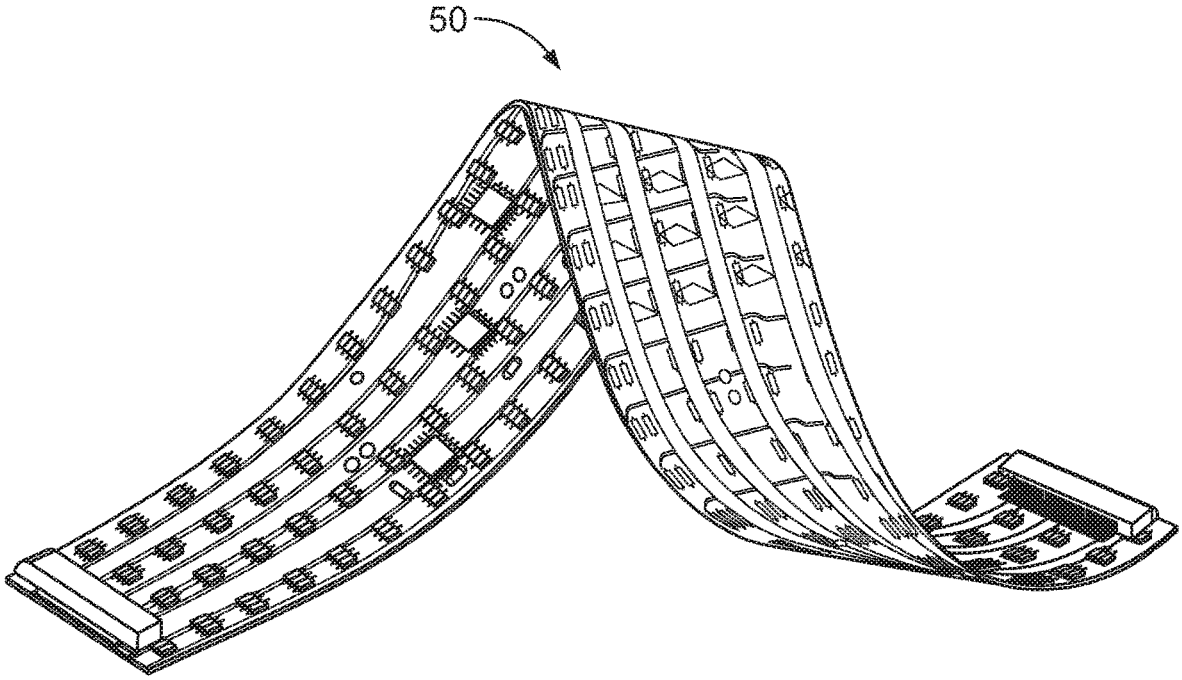
FIG. 5 is a perspective view of an example flexible circuit, to which any of the staking terminals described herein may be electrically and physically coupled.

The below devices and systems of FIGS. 6-10 provide a solution for what has historically required a rigid-type connection between a coaxial cable and a circuit board, as the advent of flexible circuits have made these types of connections more prevalent in the automotive and other industries. Referring to FIG. 5, an example flexible circuit 50 is shown. Flexible circuits, such as the flexible circuit 50 typically comprise a thin insulating polymer film having conductive circuit patterns affixed thereto. Further, these flexible circuits are typically supplied with a thin polymer coating to protect the conductor circuits. Flexible circuit technology is now one of the most important interconnection technologies in use for the manufacture of many of today's most advanced electronic products.

The flexible circuit 50 may comprise multiple layers of the same or different material, such as a polymer, a plastic, a cellulosic material, a laminated material, a recycled material, and/or combinations thereof. The flexible circuit 50 may be formed from a wide variety of well-known polymeric materials, including, for example, polyethylene (PE), low density polyethylene (LDPE), high density polyethylene (HDPE), polyethylene terephthalate (PET), crystalline PET, amorphous PET, polyethylene glycol terephthalate, polystyrene (PS), polyamide (PA), polyvinyl chloride (PVC), polycarbonate (PC), poly(styrene:acrylonitrile) (SAN), polymethylmethacrylate (PMMA), polypropylene (PP), polyethylene naphthalene (PEN), polyethylene furanoate (PEF), PET homopolymers, PEN copolymers, PET/PEN resin blends, PEN homopolymers, overmolded thermoplastic elastomers (TPE), fluropolymers, polysulphones, polyimides, cellulose acetate, and/or combinations thereof. It is further envisioned that the flexible circuit 50 may include a lining or coating. In a preferred embodiment, the flexible circuit 50 is formed from PET. While particular flexible circuits are disclosed herein, the principles of the present application may be applied to any flexible circuits.

Referring now to FIGS. 6-10, a terminal 52 in accordance with the present disclosure, which allows a coaxial cable to be coupled with the flexible circuit 50, is shown in greater detail. The terminal 52 is shown in a planar, first configuration. The terminal 52 includes a first or conductor portion 54 and a second or ground portion 56, the first portion 54 and the second portion 56 being separated or uncoupled, electrically. The conductor portion 54 includes a conductor crimp 58 and a plurality of staking tines 60. The conductor crimp 58 and the staking tines 60 extend from a conductor platform 62, which connects the conductor crimp 58 with the staking tines 60. The conductor platform 62 allows the conductor portion 54 to be an integral piece and electrically connects the staking tines 60 with the conductor crimp 58. As described in greater detail below, the conductor crimp 58 is formed to crimp to the core 28 of the coaxial cable 38 when the conductor portion 54 of the staking terminal 52 is physically and electrically coupled with the coaxial cable 38.

Figure 10:
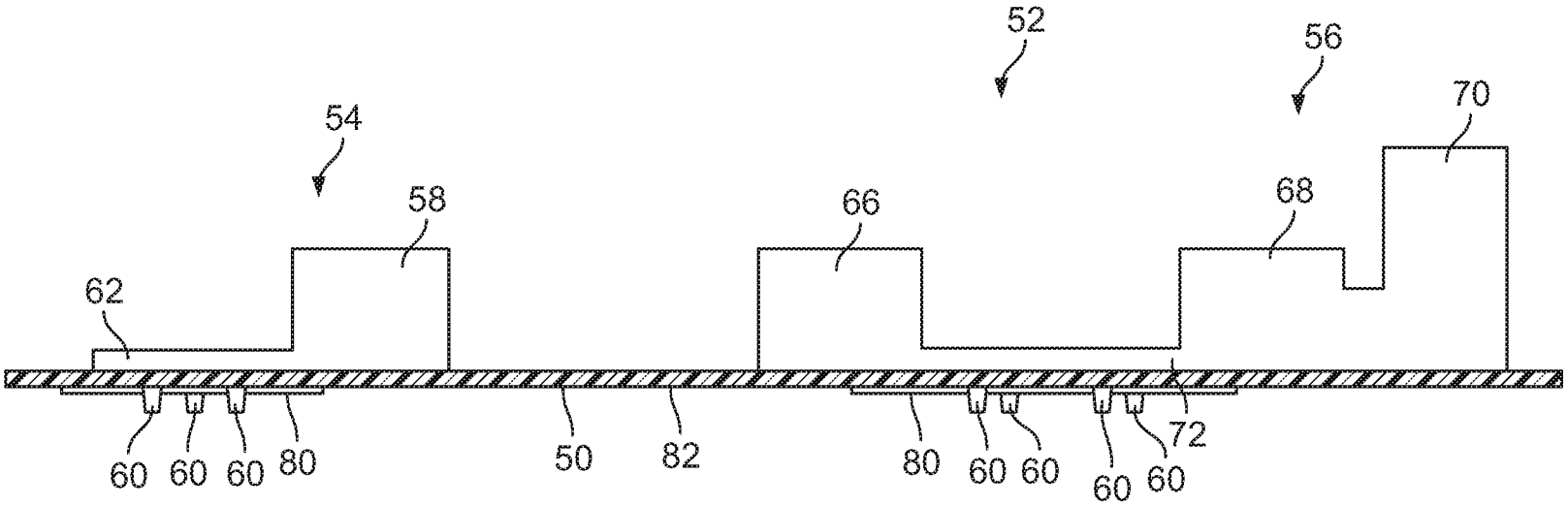
FIG. 10 illustrates a side view of the staking terminal of FIG. 6 coupled with a portion of the flexible circuit of FIG. 5, the staking terminal being shown in a third, folded and coupled orientation.

The conductor portion 54 may include any number of the staking tines 60, however, in a preferred embodiment, the conductor portion 54 includes three staking tines 60. When the staking tines 60 are coupled with the flexible circuit 50, the staking tines 60 pierce through the flexible circuit 50 (as shown in FIG. 10). Thereafter, the tines 60 become bent or folded to allow the conductor portion 54 to be disposed in electrical contact with a conductor disposed along the flexible circuit 50. In some aspects, the tines 60 may be characterized as interdigitated with one another when bent or folded. For example, in some embodiments, the staking tines 60 are interdigitated such that alternating tines are disposed opposite one another, and fold in opposing directions. As described in greater detail hereinafter below, the staking tines 60 are operable to pierce through, and fold over along a side of the flexible circuit 50 such that the conductor portion 54 can be electrically coupled with the flexible circuit 50. While not specifically shown, the conductor portion 54 may include multiple conductor crimps 58. The conductor crimp 58 is formed to be folded or crimped over the core 28 when the terminal 52 is coupled to the cable 38.

With reference again to FIG. 6, the ground or braid portion 56 includes a first braid crimp 66 and a second braid crimp 68. The first and second braid crimps 66, 68 are formed to crimp the ground portion 54 to the metallic shield 46 of the coaxial cable 38. The ground portion 56 further includes a plurality of the piercing tines 60 and an insulation crimp 70. The insulation crimp 70 may be formed to crimp the ground portion 56 to the insulation 48 of the coaxial cable 38. Since the insulation 48 has a larger outer diameter than the metallic shield 46, the insulation crimp 70 is larger than the braid crimps 66, 68. However, in some embodiments, the insulation crimp, the first braid crimp 66, and the second braid crimp 68 are the same size. The first braid crimp 66, the second braid crimp 68, the piercing tines 60, and the insulation crimp 70 are coupled to one another via a ground platform 72. The ground portion 56 includes the first braid crimp 66 and the second braid crimp 68, however, additional or fewer braid crimps are contemplated. Further, while the ground portion 56 also includes the insulation crimp 70, fewer or more insulation crimps are also contemplated.

Figure 6:
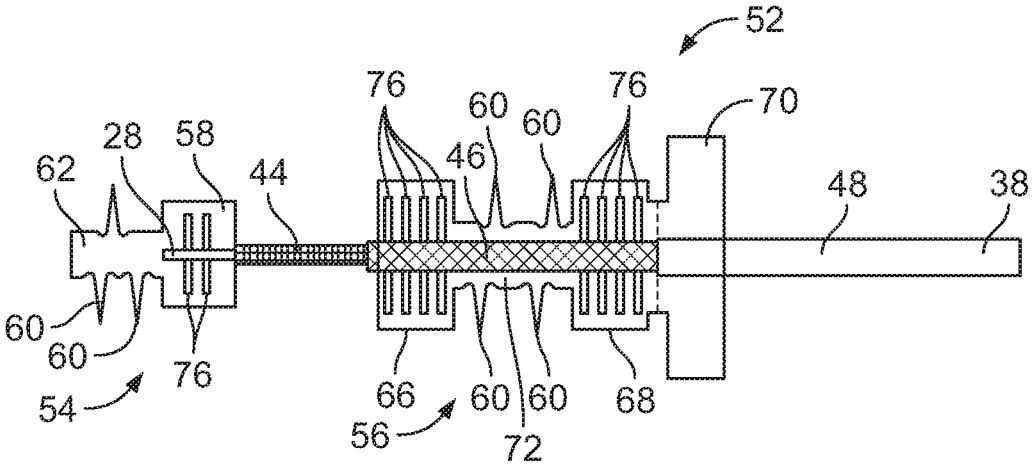
FIG. 6 is a top view of a coaxial cable resting upon a staking terminal in accordance with the present disclosure, the staking terminal being in a planar, first configuration.

Still referring to FIG. 6, the conductor portion 54 and the ground portion 56 are shown in a first or flat configuration, laid underneath the coaxial cable 38. The coaxial cable 38 is shown stripped such that portions of the core 28, the dielectric insulation 44, the metallic shield 46, and the insulation 48 are removed to allow the terminal 52 to be coupled with the cable 38. The stripped coaxial cable 38 is shown lying upon the connector portion 54 and the ground portion 56, which are also in a planar configuration. While not specifically discussed herein, the terminal 52 may be entirely formed from a stamped material, such as tin-plated brass, or another conductive material that is commonly used as a terminal. Vertical grooves 76 are included along the connector portion 54 and the ground portion 56 to increase the friction and retain the coaxial cable 38 in place when it is coupled with the terminal 52. The grooves 76 may be indentations in the material, and/or may comprise a friction-increasing material. The grooves 76 may also be horizontal, angled, or in some other type of friction-increasing orientation not specifically depicted herein.

Figure 7A:
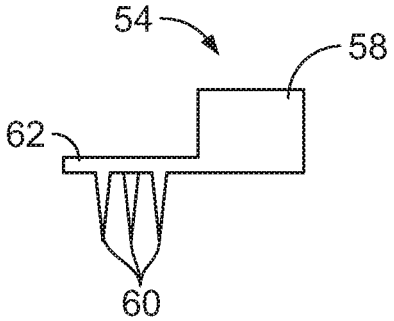
FIG. 7A is a side view of a conductor portion of the staking terminal of FIG. 6, the conductor portion being in a folded, second configuration.
Figure 7B:
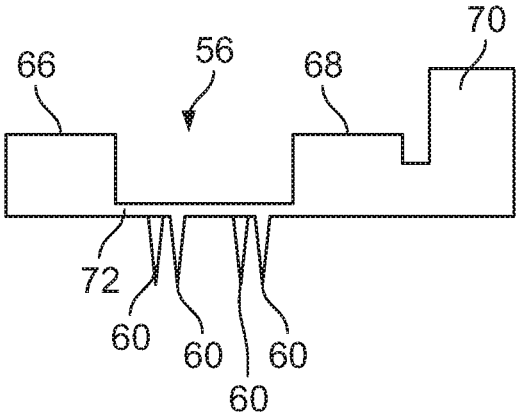
FIG. 7B is a side view of a ground portion of the staking terminal of FIG. 6, the ground portion being in a folded, second configuration.
Figure 8:
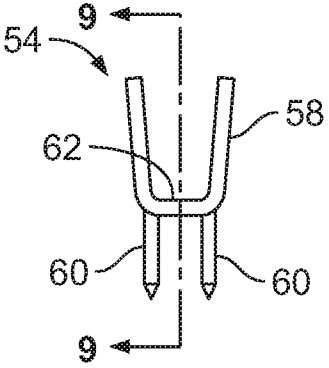
FIG. 8 is a front view of the conductor portion of FIG. 7A in the folded, second configuration.

Referring now to FIGS. 7A and 7B, the connector portion 54 and the ground portion 56 are shown in a second, folded configuration, respectively. The second, folded configuration, which is also shown in FIG. 8, involves a bending of the tines 60 downward and bending the conductor crimp 58, the braid crimps 66, 68, and the insulation crimp 70 upward. As a result, in the second, folded configuration, the tines 60 are disposed facing in an opposite direction of the crimps 58, 66, 68, 70. The terminal 58 is placed in the second, folded configuration before the coaxial cable 38 is stripped and placed into the terminal. Once stripped, the coaxial cable 38 is placed into the terminal 52 in a configuration as shown in FIG. 6. Referring to FIG. 8, the second, folded configuration is shown more clearly, wherein the tines depend downward from the platform 62, and the conductor crimp 58 extends upward, forming a well that is operable to receive a portion of the coaxial cable 38.

Figure 9:
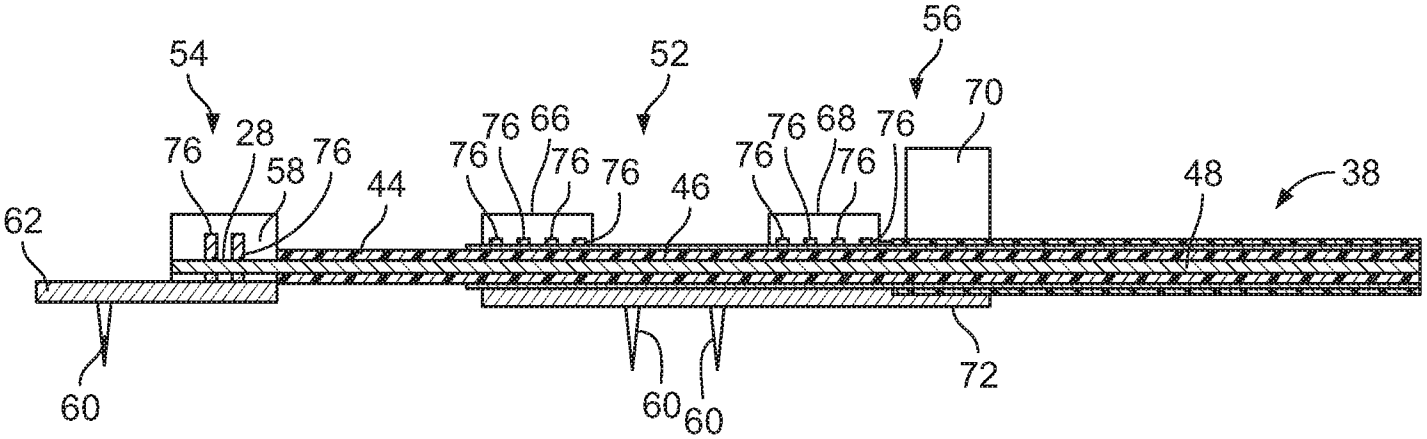
FIG. 9 is a side view of the staking terminal of FIG. 6 taken through line 9-9 of FIG. 8 having a coaxial cable secured to the conductor crimp, braid crimp, and insulation crimp, the staking terminal being in the folded, second configuration.

Referring now to FIG. 9, a cross-sectional view of the entire staking terminal 52 taken through lines 9-9 of the connector portion 54 of FIG. 8 is shown. While FIG. 8 does not show the ground portion 56 or the coaxial cable 38, reference is made to FIG. 6, which illustrates the positioning of the connector portion 54 and the coaxial cable 38 before the terminal 52 is manipulated into the second, folded configuration. As shown in FIG. 9, the conductor crimp 58 receives the core 28. Portions of the conductor crimp 58 may be folded over or otherwise crimped to the core 28 after the coaxial cable 38 is placed into the conductor crimp 58. The grooves 76 may allow the conductor crimp 58 to be more securely fastened to the core 28 due to friction. As further shown, no portion of the terminal 52 is coupled with the dielectric insulation 44. Rather, the dielectric insulation 44 extends, unattached to any portion of the terminal 52, between the conductor portion 54 and the ground portion 56 of the terminal 52. The absence of material attached to the dielectric insulation 44 allows for two separate electrical connections to be formed, so as to prevent electrical interference from obstructing or diverting a signal from either of the two electrical connections.

Still referring to FIG. 9, the metallic shield 46 is disposed within the ground portion 56 of the terminal 52. Both the first braid crimp 66 and the second braid crimp 68 are disposed adjacent the metallic shield 46, and are operable to be crimped to the metallic shield 46. As discussed above with respect to the conductor crimp 58, the grooves 76 provided along the first and second braid crimps 66, 68 allow the crimps to be more securely coupled with the metallic shield 46 when the coaxial cable 38 is inserted into the terminal 52. Portions of the metallic shield 46 may rest upon the ground platform 72, or may otherwise be suspended above the ground platform 72. However, when the terminal 52 is in an operable configuration, both the first braid crimp 66 and the second braid crimp 68 are electrically coupled with the metallic shield 46 of the coaxial cable 38.

Still referring to FIG. 9, the insulation crimp 70 is shown adjacent the insulation 48 of the coaxial cable 38. While the insulation crimp 70 is not necessary, as it provides no electrical connection between the coaxial cable 38 and the flexible circuit 50, the insulation crimp 70 is included for stability to ensure that the coaxial cable 38 remains in place when attached to the terminal 52. More insulation crimps 70 may be included. While the insulation crimp 70 does not provide an additional electrical connection, the insulation crimp 70 is unitary with the braid crimps 66, 68, thus, the insulation crimp 70 may also carry a ground signal. As discussed with respect to the crimps described above, the insulation crimp 70 may be folded over the coaxial cable 38, or may be otherwise crimped to the coaxial cable 38.

Referring now to FIG. 10, the terminal 52 is shown in a third, folded and coupled configuration. The coaxial cable 38 is shown removed from the terminal 52 for ease of discussion, however, the coaxial cable 38 would be disposed in the same configuration as shown in FIG. 9. Referring to FIG. 10, the staking tines 60 that depend from the conductor portion 54 and the ground portion 56 are shown inserted into and folded under the flexible circuit 50. The flexible circuit 50 is shown in cross-section. Conductors 80, which may be printed and/or formed from silver, are provided along an underside 82 of the flexible circuit 50. The tines 60 are folded over, and thus electrically coupled with the conductors 80. The conductors 80 are components of the flexible circuit 50, which are in electrical communication with other electrical components of the flexible circuit 50, or may be in electrical communication with some other type of electrical component. As shown in FIG. 10, the conductor portion 54 and the ground portion 56 are separated spatially, such that no electrical connection is formed between the conductor portion 54 and the ground portion 56.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The terms "about" and "approximately" indicate plus or minus 5% of the numeric value that each term precedes. The entire disclosure of each patent and publication cited herein is incorporated by reference, as if each such patent or publication were individually incorporated by reference herein. Various features and advantages of the invention are set forth in the following claims.

We claim:

1. A staking terminal for a cable comprising:
- a conductor portion comprising:
  - a conductor platform;
  - a first plurality of tines extending from the conductor platform; and
  - a conductor crimp extending from the conductor platform,
  - wherein the conductor platform and the tines are not coplanar in a folded configuration, and
- a ground portion comprising;
  - a ground platform;
  - a second plurality of tines extending from the ground platform; and
  - a first braid crimp extending from the ground platform,
  - wherein the ground platform and the tines are not coplanar in the folded configuration, and
- wherein the conductor portion is configured to connect with a first ground plane of a flexible circuit and the ground portion is configured to connect with a second ground plane of the flexible circuit.

2. The staking terminal of claim 1 further comprising a plurality of grooves provided along the conductor crimp and the braid crimp.

3. The staking terminal of claim 1, wherein the conductor portion is coplanar with the ground portion in an unfolded configuration.

4. The staking terminal of claim 1, wherein the ground portion further includes a second braid crimp spaced apart from the first braid crimp.

5. The staking terminal of claim 1, wherein the first plurality of tines can be interdigitated when the staking terminal is coupled with the flexible circuit.

6. The staking terminal of claim 1, wherein the first plurality of tines are pierced through the flexible circuit to electrically couple the conductor portion to the flexible circuit.

7. The staking terminal of claim 6, wherein the second plurality of tines are pierced through the flexible circuit to electrically couple the ground portion to the flexible circuit.

8. The staking terminal of claim 7, wherein the conductor portion is spaced apart from the ground portion when electrically coupled with the flexible circuit.

9. The staking terminal of claim 1, wherein the ground portion further includes an insulation crimp, the insulation crimp being larger than the first braid crimp.

10. A staking terminal for connecting a coaxial cable to a flex circuit, the staking terminal comprising:

a conductor portion comprising:

a first plurality of tines depending downward; and a conductor crimp extending upward, wherein the conductor crimp includes a first plurality of grooves, and a ground portion comprising;

a second plurality of tines;

a first braid crimp; and a second braid crimp, wherein the first braid crimp includes a second plurality of grooves, and the second braid crimp includes a third plurality of grooves.

11. The staking terminal of claim 10, wherein the ground portion further includes an insulation crimp.

12. The staking terminal of claim 10, wherein the conductor portion and the ground portion each comprise tin-plated brass.

13. The staking terminal of claim 10, wherein the conductor portion and the ground portion each consist of tin-plated brass.

14. The staking terminal of claim 10, wherein the first plurality of tines and the conductor crimp can be manipulated into a planar configuration, such that the first plurality of tines and the conductor crimp are coplanar.

15. The staking terminal of claim 14, wherein the second plurality of tines, the first braid crimp, and the second braid crimp can be manipulated into a planar configuration, such that the second plurality of tines, the first braid crimp, and the second braid crimp are coplanar.

16. The staking terminal of claim 10 further comprising a flexible substrate, wherein the first plurality of tines of the conductor portion and the second plurality of tines of the ground portion are inserted into the flexible substrate, and wherein the conductor portion and the ground portion are spaced apart.

17. A method of installing a staking terminal for connecting a coaxial cable to a flex circuit, the method comprising:

providing a conductor portion comprising a conductor platform, a first plurality of tines extending from the conductor platform, and a conductor crimp extending from the conductor platform, wherein the conductor platform, the first plurality of tines, and the conductor crimp are coplanar in a first configuration;

providing a ground portion comprising a ground platform, a second plurality of tines extending from the ground platform, and a first braid crimp and a second braid crimp extending from the ground platform, wherein the ground platform, the second plurality of tines, the first braid crimp, and the second braid crimp are coplanar in the first configuration;

manipulating the first plurality of tines and the second plurality of tines such that the first plurality of tines and the second plurality of tines are not coplanar with the conductor platform and the ground platform, respectively; and piercing the first plurality of tines and the second plurality of tines through a flexible substrate.

18. The method of claim 17 further comprising manipulating the conductor crimp, the first braid crimp, and the second braid crimp such that the conductor crimp, the first braid crimp, and the second braid crimp are not coplanar with the conductor platform and the ground platform, respectively.

19. The method of claim 18 further comprising crimping the conductor crimp to a core of a coaxial cable, and crimping both the first braid crimp and the second braid crimp to a metal shield of the coaxial cable.

20. The method of claim 19, wherein the ground portion further includes an insulation crimp, and the method further includes crimping the insulation crimp to a jacket of the coaxial cable.

* * * * *